US005245798A

United States Patent [19]

Carpenter

[11] Patent Number: 5,245,798

[45] Date of Patent: Sep. 21, 1993

[54] BATCH ROCKER BARREL

[75] Inventor: James H. Carpenter, Hagerstown, Md.

[73] Assignee: Pangborn Corporation, Hagerstown, Md.

[21] Appl. No.: 361,292

[22] Filed: Jun. 5, 1989

[51] Int. Cl.[5] ..... B24C 3/30

[52] U.S. Cl. ..... 51/423; 51/426

[58] Field of Search ..... 51/423, 422, 426, 424, 51/425, 319, 316, 313

[56] References Cited

U.S. PATENT DOCUMENTS

| | | | |
|---|---|---|---|
| 2,108,210 | 2/1938 | Rosenberger | 51/423 |
| 2,422,786 | 6/1947 | Keefer | 51/423 |
| 2,424,955 | 7/1947 | Potter | 51/423 |
| 2,440,819 | 5/1948 | Evans | 51/416 |
| 4,757,648 | 7/1988 | Carpenter | 51/423 |

FOREIGN PATENT DOCUMENTS

| | | | |
|---|---|---|---|
| 0143955 | 8/1983 | Japan | 51/318 |
| 0260765 | 10/1988 | Japan | 51/426 |
| 0373137 | 5/1973 | U.S.S.R. | 51/426 |
| 0506834 | 6/1939 | United Kingdom | 51/423 |
| 0539346 | 9/1941 | United Kingdom | 51/423 |

*Primary Examiner*—Robert A. Rose

*Attorney, Agent, or Firm*—Charles E. Brown

[57] ABSTRACT

This relates to an improved abrading machine which is of an inexpensive contruction and simple to maintain. Each abrading machine includes a casing in which there is mounted for oscillation a rocker barrel. The casing construction varies in accordance with the intended use of the abrading machine. In one form the casing will be provided with a combined entrance and discharge opening. In another machine the front wall of the casing is provided with an upper entrance opening and a lower exit opening through which a single work piece or work pieces in a batch may be loaded into and discharged from the rocker barrel. In a further abrading machine, loading may be effected by way of an axially movable hopper which moves into overlying relation to the rocker barrel through an end wall of the casing and discharge of work pieces is through the bottom of the casing. In all forms of the abrading machine, cleaning of work pieces is effected by way of one or more blast wheels which throws abrasive particles through an open upper end of the rocker barrel on to the work pieces loaded therein. When the cleaning time is short, the blast wheel may be continuously rotated and valve means may be provided for controlling the supply of abrasive particles to the blast wheel.

2 Claims, 4 Drawing Sheets 110
106
136
134
132
104
120
140
108
118
114
112
138
128
130
124
136
186
124
186
130
88
118
98
120
96
102
100

BATCH ROCKER BARREL

Batch tumbling barrels have for the last 30 to 40 years been the most widely used machine for cleaning castings that can be tumbled. These machines are available from many vendors in sizes ranging from 1 to 76 cubic feet capacity. Typically, these machines are constructed as disclosed in U.S. Pat. No. 2,716,310. It can be seen from the drawings of that patent that the tumbling section consists of many individual parts such as slats, links, pins, sprockets, etc. This multiplicity of parts results in a machine that is costly to maintain and in some cases, too expensive for some customers to purchase.

The object of this invention is to develop a selectively single part or batch tumbling machine that is less expensive to manufacture and less expensive to maintain than the current tumbling machines.

This invention incorporates a rocker barrel of the type generally disclosed in U.S. Pat. No. 4,680,898, except that in accordance with this invention the work pieces or parts to be cleaned do not continuously flow axially through the rocker barrel. In accordance with this invention, work pieces to be cleaned are loaded into a closed end rocker barrel and are tumbled by the rocking action of the rocker barrel. The rocker barrel rocks back and forth through a total arc of approximately 130° for each rotation. After a pre-determined blast time, the work pieces are either manually or automatically unloaded and another batch of work pieces are loaded.

The work pieces being tumbled within the rocker barrel are cleaned by a blast of abrasive particles thrown into the rocker barrel by one or more blast wheels. Each blast wheel is motor driven and has high inertia with the result that considerable time is required to stop the rotation of the blast wheel and also to get the blast wheel up to rotational speed after each stoppage. Accordingly, in accordance with this invention, it is proposed to continuously run the blast wheel.

In a simplest form of the invention, either a single work piece or a batch of small work pieces is directed into the open top of the rocker barrel through an opening which serves both as an entrance opening and exit opening. When the rocker barrel is to be loaded or unloaded, it is rotated beyond its normal oscillation limit so as to align the open top of the rocker barrel with the combined entrance and exit opening. In order to effect the loading or discharge, it is necessary to open a door forming part of the casing. Further, it is necessary to make certain that stray abrasive particles or accidentally exploding wheel parts do not strike the operator who is loading or unloading the rocker barrel.

In this simplest form of the invention, it is necessary to discontinue the discharge of abrasive particles. The rocker barrel is rotated to its loading or discharging position. A longitudinal trough portion on the exterior of the rocker barrel becomes aligned with the path of abrasive particle discharge and contains any stray abrasive particles or accidentally exploding wheel parts.

While the blast wheel continues to rotate, the supply of abrasive particles to the blast wheel is discontinued momentarily during the discharging and loading of the rocker barrel.

In another form of the invention, the casing may be provided with a separate entrance opening adjacent the top of the casing and a separate discharge opening at the bottom of the casing. With this arrangement, if desired, the trough may be eliminated and the feeding of the abrasive particles to the blast wheel discontinued during the discharge and loading cycles.

In a further form of the invention, the entrance opening is formed in the end of the casing and the work pieces to be cleaned are loaded externally of the rocker barrel casing into a hopper which is then moved axially into the casing into overlying relation to the open end of the rocker barrel to discharge the work pieces into the stationary rocker barrel. Discharge of the cleaned work pieces will be at the bottom of the casing.

With the above and other objects in view that will hereinafter appear, the nature of the invention will be more clearly understood by reference to the following detailed description, the appended claims, and the several views illustrated in the accompanying drawings.

Figure 2:
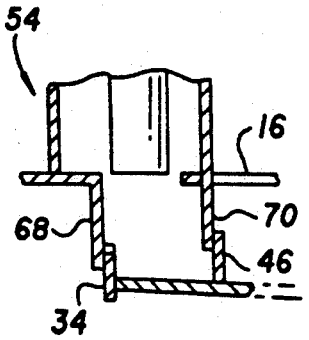
FIG. 2 is an enlarged fragmentary sectional view showing the details of a trough formed on the exterior of the rocker barrel adjacent the opening thereof in cooperation with combined stop and guide means carried by the casing to assure containment of stray abrasive particles.
Figure 1:
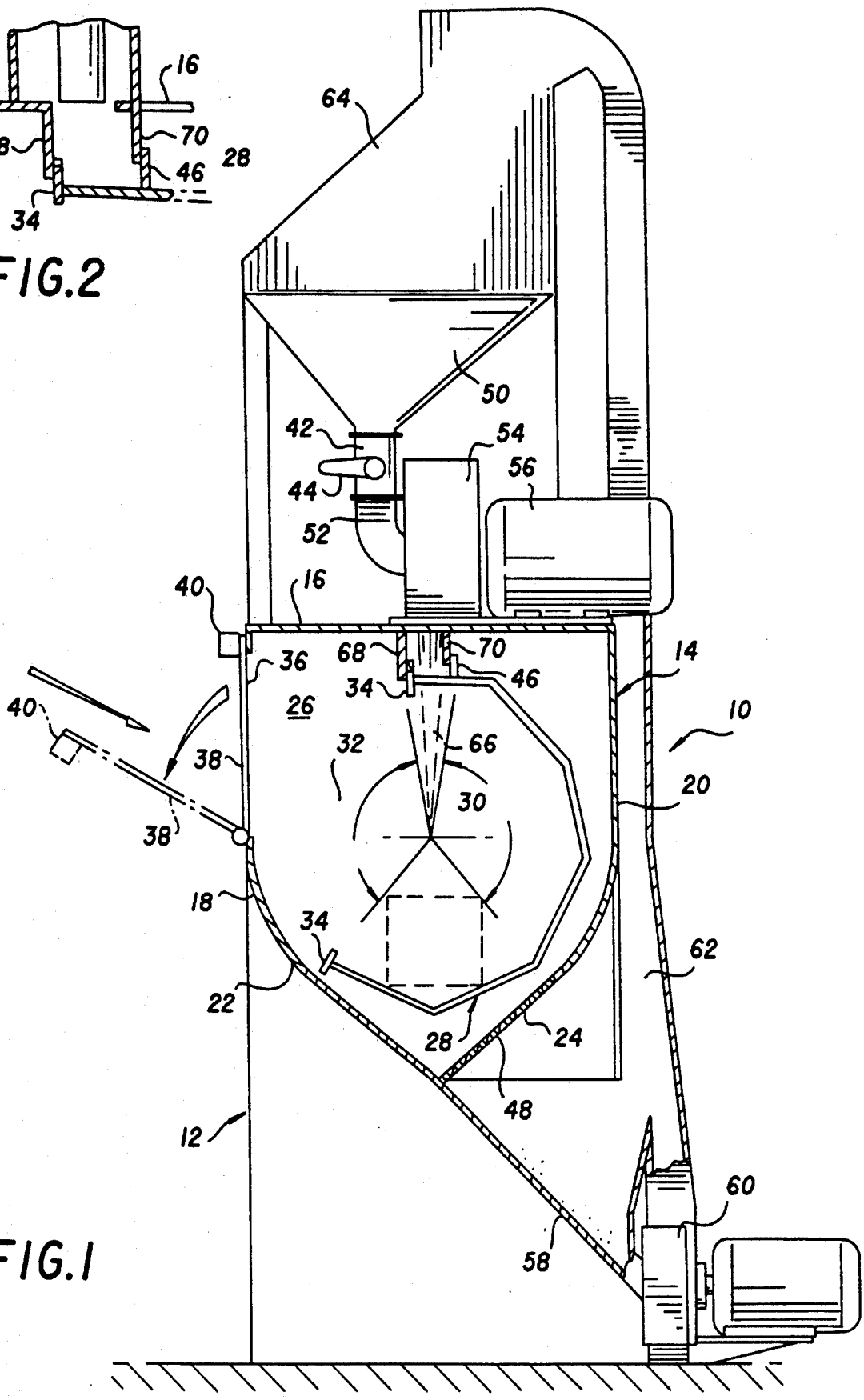
FIG. 1 is a part elevational view of an abrading machine with parts broken away and shown in section and shows the details of one form of rocker barrel and casing wherein a single opening functions as a loading and discharge opening and there are means for containing stray abrasive particles or accidentally exploding wheel parts and keeping them away from such opening.

Referring now to the drawings in detail, reference is first made to the abrading machine of FIGS. 1 and 2 which is generally identified by the numeral 10. The abrading machine 10 includes an upstanding structure, generally identified by the numeral 12, which includes a casing, generally identified by the numeral 14. The casing 14 includes a top wall 16, side walls 18 and 20, and converging bottom walls 22 and 24. The casing 14 also includes opposite end walls 26.

A rocker barrel, generally identified by the numeral 28, is mounted within the casing 14 for oscillatory movement about a substantially horizontal axis 30. Mounting of the rocker barrel 28 and oscillation thereof is effected in a conventional manner.

The rocker barrel 28 has an open top 32 which is in part defined by longitudinal strap-like edges 34.

A major part of the side wall 18 is in the form of a combined entrance and exit or discharge opening 36 normally closed by a hingedly mounted door 38. The door 38 is normally retained in a closed position by means of a latch mechanism 40.

It is to be noted that the lowermost part of the bottom wall portion 24 is in the form of a screen 48 which permits the return of abrasive particles while preventing any accidental dropping of cleaned work pieces and the like into the abrasive particle return area.

A supply bin 50 for abrasive particles is mounted above the casing 14 and is provided with a supply tube 52 for directing abrasive particles into the center of a throwing mechanism 54 which includes a conventional blast wheel driven by an electric motor 56. Control of the flow of abrasive particles to the blast wheel is by way of a valve mechanism 42 incorporated in the supply tube 52. The valve mechanism is actuated by means of a control handle 44 which will be provided with a suitable actuator (not shown) for automatic actuation.

Abrasive particles passing through the screen 48 preferably move down into a reclaiming chute area 58 where they are directed to a throwing wheel 60 which throws the reclaimed abrasive particles upwardly through an elevating casing 62. The returning used abrasive particles are directed by the elevating chute 62 into an uppermost cleaner 64 which overlies the bin 50. In the cleaner 64, foreign matter usually accumulated during the cleaning operation is removed from the abrasive particles and separately discharged in a manner which forms no part of this invention.

OPERATION

With the rocker barrel 20 stopped generally in the position shown in FIG. 1, the door 38 may be moved to its open position as is shown in dash dot lines, and the rocker barrel 28 may be first emptied, after which there may be placed in the rocker barrel 28 through the opening 36 either a large piece or a batch of pieces to be cleaned. At this time it is to be noted that the latch mechanism 40 can be operated to open the door 38 only when the rocker barrel 28 is in its stationary loading and unloading position.

Normally the rocker barrel 28 is oscillated at about the axis 30 through an arc on the order of 130°. The extent of the oscillation and the width of the top opening 32 are such that a stream of abrasive particles 66 thrown by the blast wheel will always enter into the top opening 32 of the rocker barrel 28.

Referring now most specifically to FIG. 2, it will be seen that carried by the top wall 16 of the casing 14 is a pair of spaced guides 68, 70 which extend down from the casing 14. The guides assure the containment of stray abrasive particles and accidentally exploding wheel parts so that the rocker barrel 28 may be readily loaded through the entrance opening 36 without any possible injury to the worker loading the rocker barrel 28. Most particularly, it will be seen that the corresponding edge 34 abuts tightly against the guide 68 while a further plate 46 tightly abuts against the guide 70. The elements 34, 46 cooperate with an adjacent outer portion of the rocker barrel 28 to define a trough whereby stray abrasive particles are contained.

At this time it is pointed out that while the motor 56 continues to run and thus continues to rotate the blast wheel, unloading and loading may be effected through the opening 36 without any possible injury to the workmen. The valve 42 is closed and the trough defined by the rocker barrel will catch only stray particles and accidentally exploded wheel parts.

Further, all components of the machine surrounding the blast wheel form a rugged shield in case the blast wheel or vanes thereof should explode due to centrifugal force or because of foreign matter falling into the blast wheel.

Figure 3:
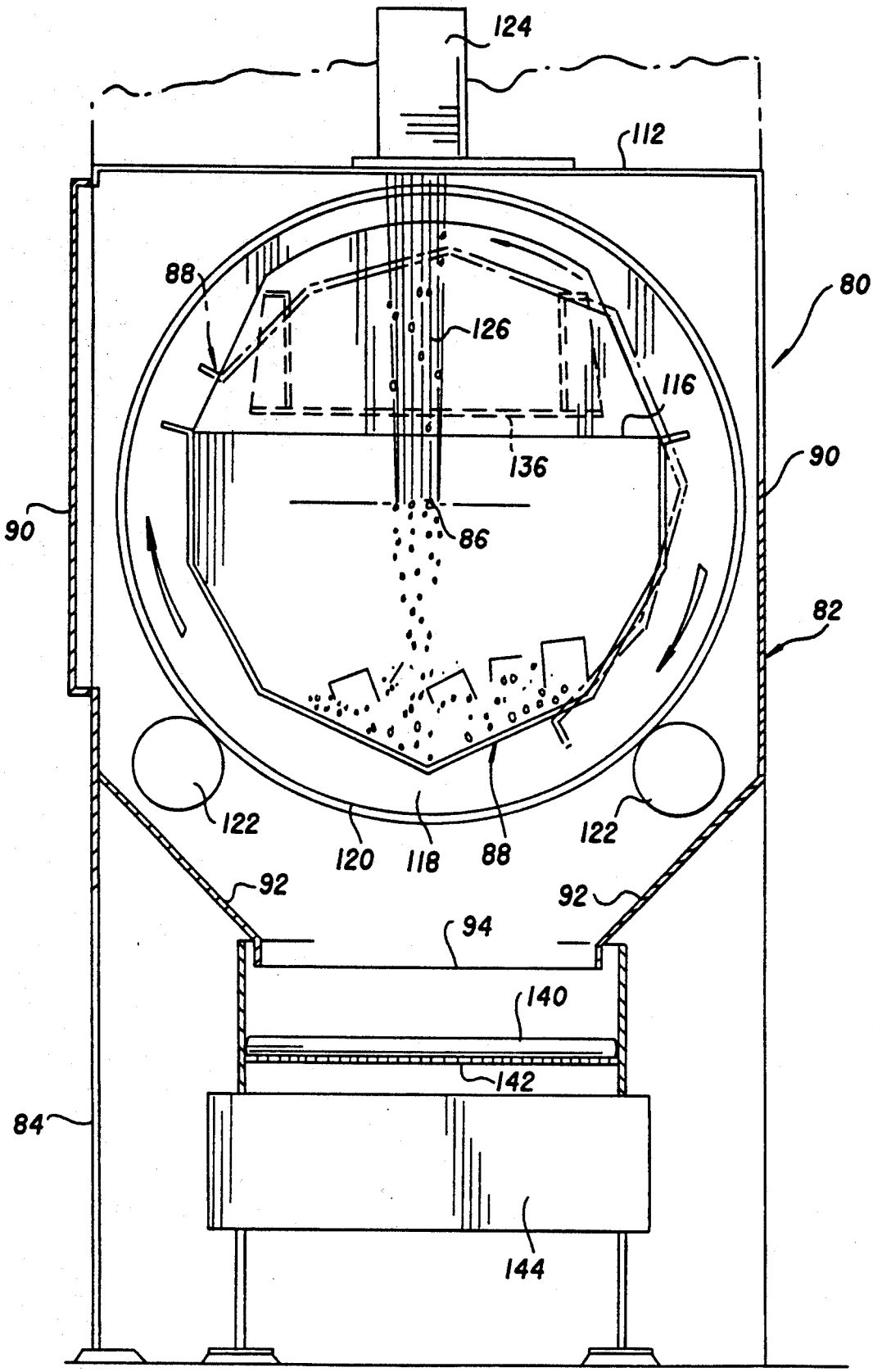
FIG. 3 is an end elevational view of a modified form of the abrading machine in accordance with this invention with parts broken away and shown in section and shows the specific details of the means for loading and unloading the rocker barrel.
Figure 4:
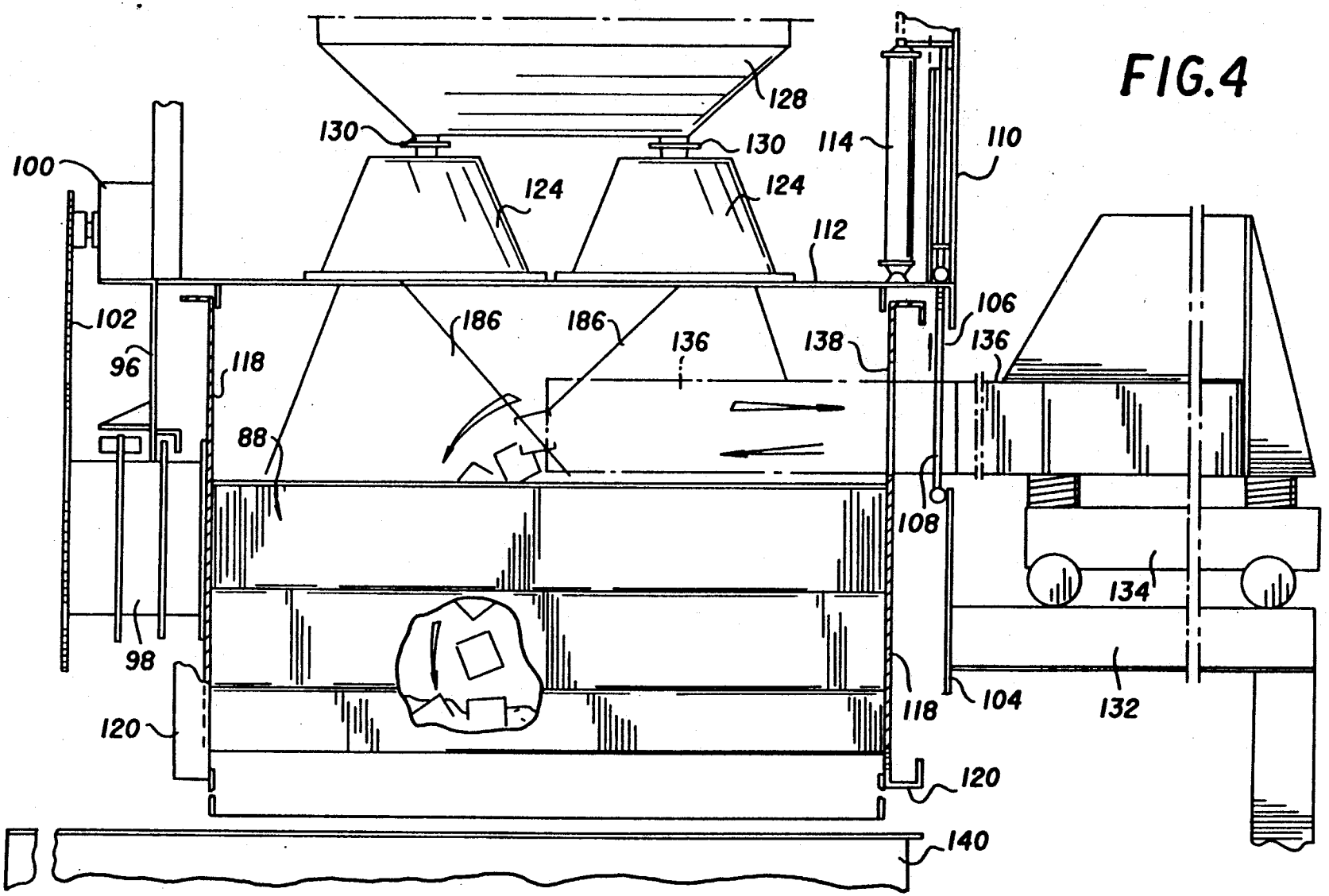
FIG. 4 is a side elevational view of the abrading machine of FIG. 3 with parts broken away as shown in section and shows the manner in which the rocker barrel is loaded and unloaded.

Referring now to FIGS. 3 and 4, it will be seen that there is illustrated another form of the abrading machine in accordance with this invention, this abrading machine being generally identified by the numeral 80. The abrading machine 80 includes a casing 82 of which only parts are shown. The casing 82 is supported in an elevated position by way of a lower housing 84 and has mounted therein for oscillation about a fixed, substantially horizontal axis 86, a rocker barrel 88.

The casing 82 includes side walls 90 which terminate at their lower ends in downwardly sloping converging bottom walls 92, which, in turn, terminate in an exit for a discharge opening 94.

The casing 82 also includes at one end an end wall 96 which carries a suitable bearing assembly 98 which serves to mount the rocker barrel 88 for oscillation. Oscillation of the rocker barrel 88 is effected by means of a motor 100 by way of a chain drive 102.

The casing 82 includes a partial end wall 104 at the opposite end of the casing 82 with the end wall 104 having in an upper part thereof an entrance opening 106 which is normally closed by a vertical sliding door 108. The door 108 is slidably mounted for vertical movement within a guideway 110 carried by a top wall 112 of the casing. An extensible fluid motor 114, which is mounted on the top wall 112, is connected to the upper part of the door 106 to effect vertical sliding of the door 106 within the guideway 110 when it is desired to load the rocker barrel 88.

The rocker barrel 88 is generally of a U-shaped cross section and has an open top 116. It is to be noted that the rocker barrel 88 is of a multi-sided construction and, as illustrated, has six sides.

The rocker barrel 88 is provided with a pair of remote end plates 118 each of which includes a cylindrical flange 120 with the flanges 120 being seated on rollers 122. In this manner the rocker barrel 88 is supported for oscillatory movement about the axis 86.

Referring now to FIG. 4, it will be seen that mounted on the top wall 112 of the casing 82 is a pair of axially aligned blast heads 124 each of which includes a conventional blast wheel (not shown). The blast wheels receive abrasive particles 126 from an overhead supply bin 128 through supply pipes 130 which open into the centers of the blast wheels. The supply pipes 130 will be provided with control valves corresponding to the control vavle 42 so that the blast wheels may continue to rotate during the loading and unloading operation.

The abrasive particles 126 are delivered into the casing 82 and to the rocker barrel 88 through the open top 116 in a generally fan shaped pattern as is shown in FIGS. 3 and 4 to clean work pieces which have been loaded into the rocker barrel 88.

A trackway 132 extends axially from the end wall 104 and has mounted thereon a wheeled carriage 134. The carriage 134, in turn, carries for axially reciprocating movement therewith a hopper unit 136 which is horizontally oriented. The hopper unit 136 is aligned with the entrance opening 106. Further, that end panel 118 of the rocker barrel 88 positioned adjacent the end wall 104 of the casing is provided with an entrance opening 138 which is aligned with the entrance opening 106 when the rocker barrel 88 is in its centered position shown in FIG. 3.

OPERATION

Thus while one batch of work pieces is being cleaned, another batch of such work pieces may be accumulated in that part of the hopper assembly 136 closest the casing 82. When it is desired to load the rocker barrel 88, the rocker barrel 88 is stopped in the position shown in FIG. 3 with this position then, by way of control means (not shown) permits the extensible fluid motor 114 to be first actuated to open the door 108 followed by the hopper assembly moving into the upper part of the rocker barrel between the end panels 118 so as to dump the work pieces to be cleaned into the rocker barrel 88 as is generally shown in FIG. 4.

After the hopper assembly 136 has been emptied, it is retracted for receiving a new batch of work pieces, followed by the extensible fluid motor 114 again being actuated so as to move the door 108 to its closed position. At this time, the motor 100 can be energized to again oscillate the rocker barrel 88.

Referring once again to FIG. 3, it is to be understood that the oscillation of the rocker barrel is somewhat limited, generally through an angle on the order of 130°–135° in each direction. Thus the open top 116 of the rocker barrel 88 is, during a normal operating condition, aligned with the discharge of the blast heads 124 to effect cleaning of work pieces.

After the work pieces have been cleaned, normal oscillation of the rocker barrel 88 is discontinued and the rocker barrel 88 is rotated in a counter clockwise direction beyond its normal operating position to that shown in dotted lines at the top of FIG. 3. When so positioned, the open top 116 opens generally downwardly and the work pieces are discharged into the lower portion of the casing out of the exit opening 94.

Preferably, there is positioned beneath the exit opening 94 a conveyor 140 which will move the cleaned work pieces axially away from the abrasive machine 80.

The conveyor 140 may have a screen type bottom 142 to which the abrasive particles 86 may pass into a return mechanism 144.

It is to be understood that in the event the cleaning of the work pieces is a short cycled one, while the blast wheels may continue to rotate, the supply of abrasive particles to the blast wheels will be discontinued when the rocker barrel 88 is not being oscillated and work pieces are being discharged therefrom and thereafter loaded thereinto.

Figure 5:
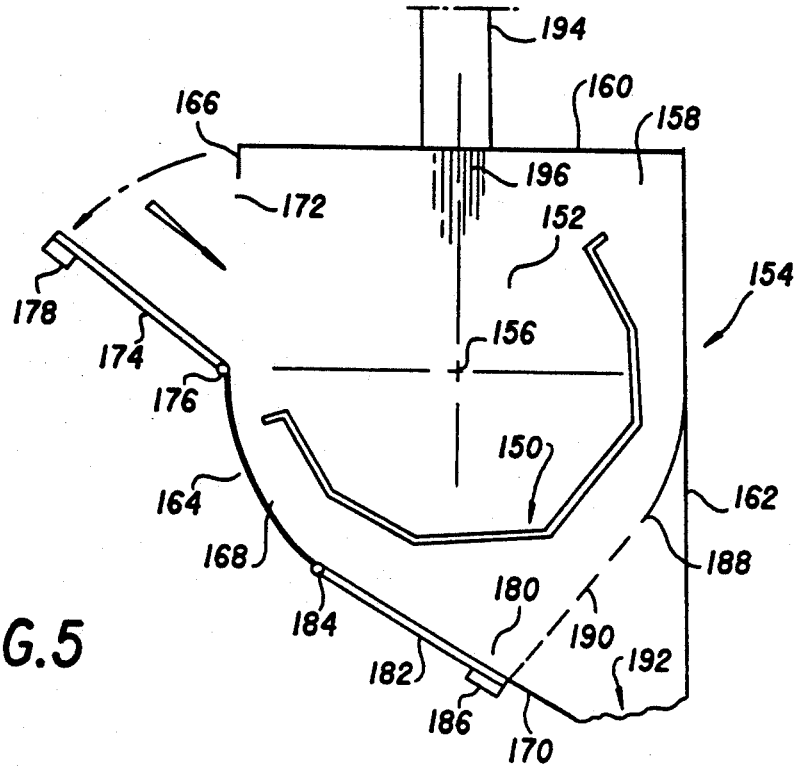
FIG. 5 is a schematic sectional view similar to the central portion of FIG. 1 and shows a modified rocker barrel casing arrangement wherein there is a separate upper entrance opening and a separate bottom discharge opening and shows the rocker barrel in its loading position.
Figure 6:
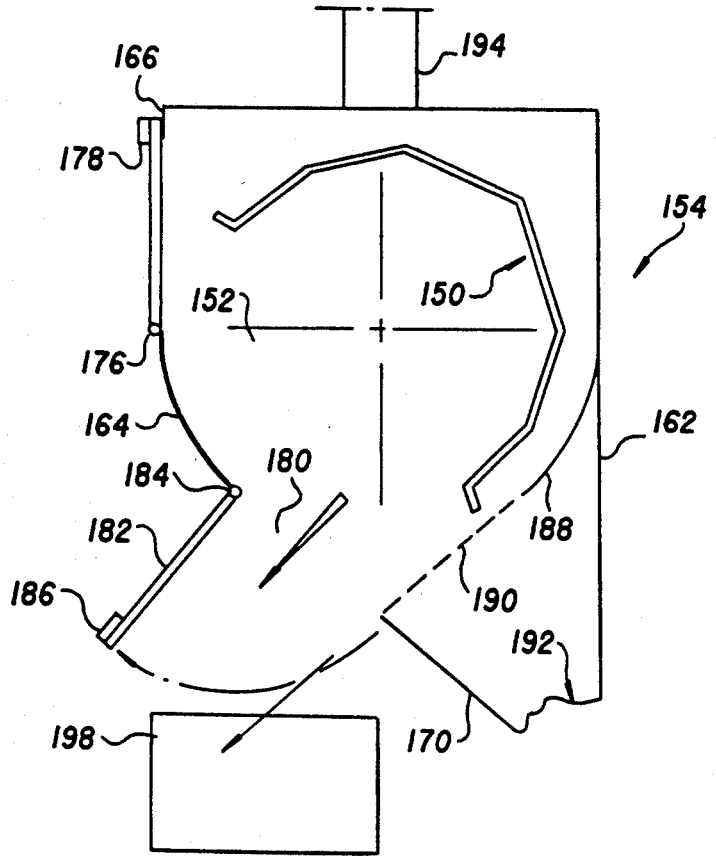
FIG. 6 is a sectional view similar to FIG. 5 and shows the rocker barrel rotated beyond its normal oscillation range to its discharge position.

Reference is now made to a third embodiment of the invention as is schematically illustrated in FIGS. 5 and 6. The invention relates to a rocker barrel, generally identified by the numeral 150 which is generally octagonal in cross section and is provided with an open top 152. The rocker barrel 150 is suitably mounted within a casing, generally identified by the numeral 154, for rotation about a generally horizontal axis 156.

The casing 154 includes a pair of end walls 158 which have extending therebetween a top wall 160, a rear wall 162 and a composite front wall 164 which includes a vertical upper portion 166, a curved intermediate portion 168 and a downwardly and rearwardly sloping lower portion 170.

The upper portion 166 is provided with an entrance opening 172 which is normally closed by a door 174 having a pivot 176 and being provided with a latch mechanism 178. In a like manner, the lower portion 170 is provided with an exit opening 180 which is closed by a door 182 having a pivot 184 and being provided with a latch mechanism 186.

The casing 154 is provided with an interior wall 188 of which a lower portion is in the form of a screen 190 with the bottom part of the casing 154 below the screen 190 leading to a used abrasive particle take away as indicated by the arrow 192.

A customary blast wheel or wheels 194 is mounted on the top wall 160 for throwing abrasive particles 196 into the casing 154 and into the open top 152 of the oscillating rocker barrel 150. The blast wheel 194 is provided with the abrasive supply system of FIG. 1 and includes a control valve (not shown) corresponding to the control valve 42 for controlling the supplying of abrasive particles to the blast wheel 194.

OPERATION

First of all, it is to be understood that the blast wheel 194 is to be driven such as by way of an electric motor corresponding to the electric motor 56 of FIG. 1 and that the blast wheel 194 will be stopped. With the supply of abrasive particles to the blast wheel 194 discontinued and with the rocker barrel 150 stopped in its position of FIG. 5, the latch mechanism 178 is automatically released and the door 174 may be opened so that a single part or a batch of parts may be loaded into the rocker barrel 150. Then, after the door 174 has been shut and the motor started, the supply of abrasive particles 196 may be continued to the blast wheel 194 while the rocker barrel is oscillated to effect cleaning of the part or parts loaded into the rocker barrel 150.

After the part or parts have been abrasively cleaned for a prescribed limited period of time, the blast wheel is stopped and the supply of abrasive particles 196 to the blast wheel 194 is discontinued and the latch mechanism 186 is actuated so that the door 182 may be swung to its open position of FIG. 6. At this time the rocker barrel 150 is rotated past its normal oscillation path to that shown in FIG. 6 at which time the part or parts having been cleaned therein are gravity unloaded with the part or parts going into a conventional tote box 198.

Once the work pieces have been discharged from the rocker barrel 150, the rocker barrel 150 will then be rotated to its position of FIG. 5 after which the door 182 is closed and the door 174 is opened to receive another load of part or parts to be cleaned. The operation of the cleaning apparatus is then repeated.

Although only three preferred embodiments of the invention have been specifically illustrated and described herein, it is to be understood that minor variations may be made in the abrading machines without departing from the spirit and scope of the invention as defined by the appended claims.

I claim:

1. A rocker barrel type abrading machine comprising a casing, an elongated rocker barrel having mounting means mounting said entire rocker barrel in said casing for oscillation about a substantially horizontal longitudinal axis, said rocker barrel having an axially extending open top, abrasive blast means including a blast wheel carried by said casing in overlying relation to said rocker barrel open top for directing abrasive particles in a longitudinal plane into said rocker barrel against work pieces carried by said rocker barrel, said casing having exit and entrance opening means for supplying work pieces to said rocker barrel and discharging of cleaned work pieces, said casing also having an abrasive particle return, said abrading machine being improved by said blast wheel being continuously operating at operating speed with the normal oscillatory movement of said rocker barrel during a work piece cleaning operation having said rocker barrel ossillating open top constantly in alignment with said abrasive blast plane, and said rocker barrel being further rotatable about said axis to selectively load work pieces and discharge cleaned work pieces through said open top, wherein said entrance and exit opening means are controlled by a door forming an upper side wall portion of said casing and defining access to the interior of said rocker barrel through said open top, wherein said door has lock means for preventing opening of said door when said rocker barrel is being oscillated.

2. A rocker barrel type abrading machine comprising a casing, an elongated rocker barrel having mounting means mounting said entire rocker barrel in said casing for oscillation about a substantially horizontal longitudinal axis, said rocker barrel having an axially extending open top, abrasive blast means including a blast wheel carried by said casing in overlying relation to said rocker barrel open top for directing abrasive particles in a longitudinal plane into said rocker barrel against work pieces carried by said rocker barrel, said casing having exit and entrance opening means for supplying work pieces to said rocker barrel and discharging of cleaned work pieces, said casing also having an abrasive particle return, said abrading machine being improved by said blast wheel being continuously operating at operating speed with the normal oscillatory movement of said rocker barrel during a work piece cleaning operation having said rocker barrel oscillating open top constantly in alignment with said abrasive blast plane, and said rocker barrel being further rotatable about said axis to selectively load work pieces and discharge cleaned work pieces through said open top, wherein said entrance and exit opening means includes a separate exit opening at a bottom of said casing and a separate entrance opening at an end of said casing.

* * * * *